US007579538B2

(12) United States Patent
Franz

(10) Patent No.: US 7,579,538 B2
(45) Date of Patent: Aug. 25, 2009

(54) MUSIC INSTRUMENT

(75) Inventor: Torsten Franz, Plaaz (DE)

(73) Assignee: Roland Meinl Musik-Instrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 12/026,177

(22) Filed: Feb. 5, 2008

(65) Prior Publication Data

US 2008/0264237 A1 Oct. 30, 2008

(30) Foreign Application Priority Data

Feb. 5, 2007 (DE) ..... 20 2007 001 871 U
Aug. 28, 2007 (DE) ..... 10 2007 040 464

(51) Int. Cl.
*G10D 13/08* (2006.01)
*G10D 13/02* (2006.01)

(52) U.S. Cl. ..... 84/402; 84/422.1; 84/411 R

(58) Field of Classification Search ..... 84/422.1, 84/411 R, 402
See application file for complete search history.

(56) References Cited

U.S. PATENT DOCUMENTS 3,521,518 A * 7/1970 Cohen ..... 84/402
6,177,620 B1 * 1/2001 Alulyan ..... 84/415
7,071,400 B1 * 7/2006 Lombardi ..... 84/402
7,399,916 B1 * 7/2008 Lombardi ..... 84/422.1
7,482,522 B2 * 1/2009 Wening ..... 84/415
7,485,787 B2 * 2/2009 McMichen, III ..... 84/402
2001/0047715 A1 * 12/2001 Rice ..... 84/402
2008/0264237 A1 * 10/2008 Franz ..... 84/422.1

OTHER PUBLICATIONS

"Meinl Percussion: Foot Cabasa . . . ", Dawson, Michael, review from Modern Drummer, dated Jul. 1, 2008, describing the Meinl Foot Cabasa, viewed on Apr. 9, 2009 at www.highbeam.com/DocPring.aspx?DocId=1P3:1490615951.*

Meinl Foot Cabasa, ad at Musician's Friend, viewed Apr. 9, 2009 at drums-percussion.musiciansfriend.com/product/Meinl-Food-Cabasa?sku=4912321.*

* cited by examiner

*Primary Examiner*—Jeffrey Donels
*Assistant Examiner*—Robert W Horn
(74) *Attorney, Agent, or Firm*—Browdy and Neimark, P.L.L.C.

(57) ABSTRACT

In a musical instrument (1), comprising a so-called cabasa (2) with a cylindrical main body (3), about the periphery of which beaded sounding bodies (4) extend that interact with the surface of the main body (3) to produce a tone when a shaking movement is performed, and a joined-on handle (5) that extends away from the main body (3), provision is made that the joined-on handle (5) is mounted in a manner so as to be able to pivot, that a foot pedal (12) is provided, and that a pivot movement of the foot pedal (12) is converted by means of a transmission device, particularly a transmission linkage or toothed belt, into a pivot movement of the joined-on handle (5).

8 Claims, 4 Drawing Sheets

MUSIC INSTRUMENT

The invention relates to a musical instrument, comprising a so-called cabasa with a cylindrical main body, about the periphery of which beaded sounding bodies extend that interact with the surface of the main body to produce a tone when a shaking movement is performed, and a joined-on handle that extends away from the main body.

Cabasas are known as rhythm instruments and have a very characteristic tone color. They are usually played in such a manner that the joined-on handle or grip is grasped with one hand, and a rhythmic shaking movement of the hand causes the sounding bodies to impact against or slide along the metal surface of the main body.

Playing the cabasa usually requires both hands, making it impossible to simultaneously play the drums or any other musical instrument with two hands.

With this as the as the starting point, the invention is based on the object of improving a cabasa in a manner such that it can be used even more universally.

This object is met according to the invention in such a way that the joined-on handle is mounted in a manner so as to be able to pivot, that a foot pedal is provided, and that a pivot movement of the foot pedal is converted by means of a transmission device, particularly a transmission linkage or a toothed belt, into a pivot movement of the joined-on handle.

The cabasa player accordingly has two free hands available with which to play any desired additional musical instrument.

A base plate is preferably provided for mounting the cabasa, with supports extending in an upwardly direction from one end of the base plate, wherein pivot bearings for the joined-on handle of the cabasa are disposed in the region of the upper ends of the supports, and wherein a pivot bearing for the foot pedal is disposed in the region of the end of the base plate opposite the supports.

The transmission linkage is advantageously implemented in such a way that, on the joined-on handle of the cabasa, a second lever is provided, which is connected via a pivot joint to a first lever arm, wherein both lever arms together enclose an acute angle, and wherein the end of the second lever aim opposite the pivot joint is provided [sic] via an additional pivot joint to the foot pedal or to an extension of the foot pedal.

Additionally, a reset spring may be provided, which pulls or pushes the foot pedal back into its normal position at an incline relative to the base plate after a downward deflection.

The reset spring may advantageously be implemented in the form of a helical spring that is affixed at one end to the top surface of the supports, and at the other end to the foot pedal.

An additional embodiment provides that between the joined-on handle of the cabasa and the first lever arm, a lockable free-wheel mechanism is disposed, which effects that, in dependence upon whether it is locked or not, both the upward and downward movement of the foot pedal are converted into a pivot movement of the cabasa, or only one of these movements.

The invention will be described in more detail below based on a preferred exemplary embodiment in conjunction with the drawing, in which.

Figure 1:
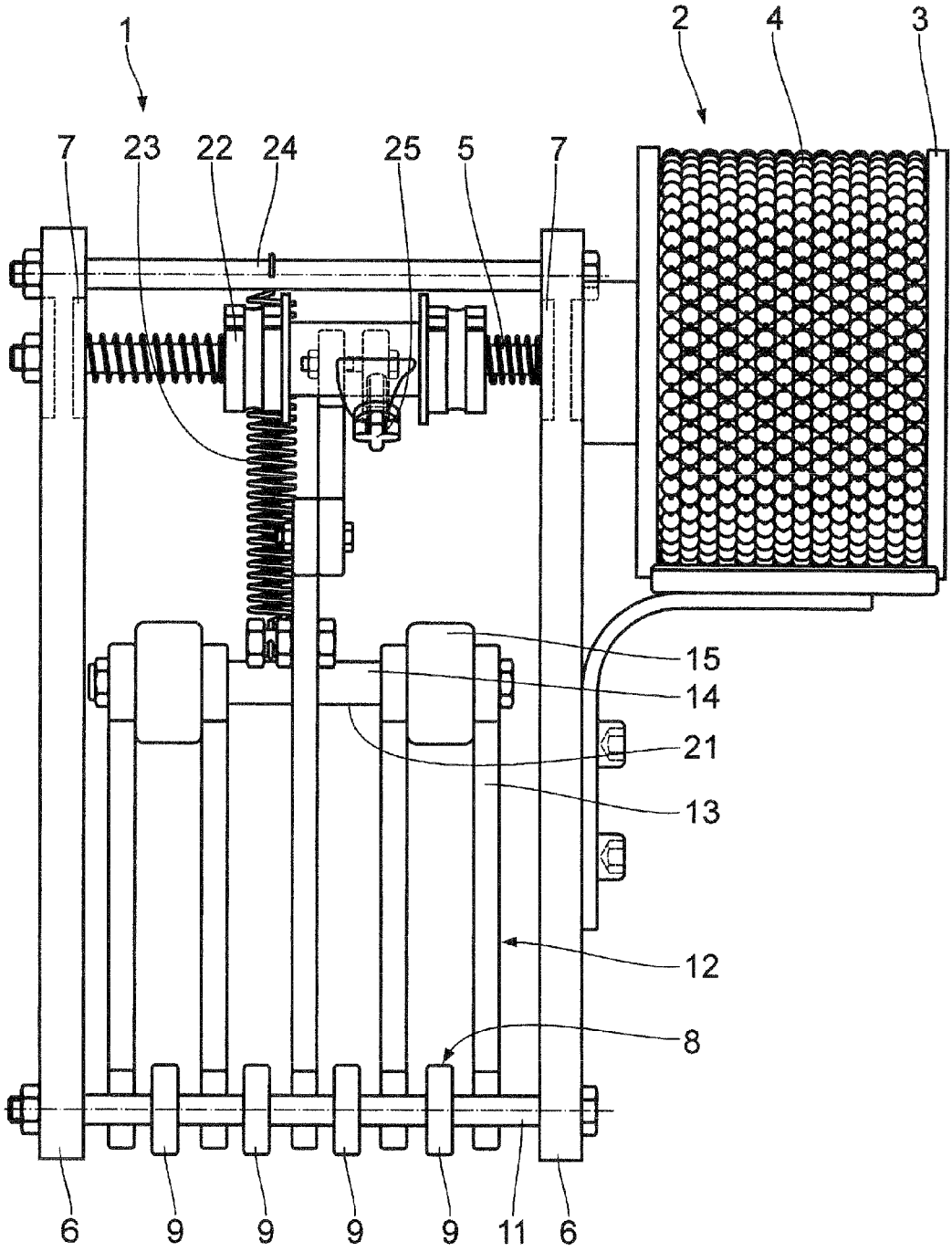
FIG. 1 shows a view of an inventive musical instrument from the front.

A musical instrument 1 shown in the drawing comprises a cabasa 2 having a drum-shaped main body 3 and a plurality of beaded sounding bodies 4 extending about the periphery of the main body 3 in the style of a string of beads.

A joined-on handle 5 is connected to the main body 3 and mounted on two supports 6 via pivot bearings 7 in a manner so as to be able to pivot. The supports 6, in turn, are connected at right angles to a base plate 8, which is composed of a plurality of bars 9 that extend parallel to each other.

At the end 10 of the base plate 8 opposite the supports 6, a foot pedal 12 is mounted via a pivot bearing 11 in a manner so as to be able to pivot, the foot pedal 12, in turn, being composed of a plurality of bars 13 that can downwardly engage between the bars 9 of the base plate 8 when the foot pedal 12 is depressed.

At the end of the foot pedal 12 opposite the pivot bearing 11, a bolt 14 is provided, onto which attenuating rollers 15 are placed that dampen the striking of the end stop when the foot pedal 12 is being fully depressed downward, to prevent a metallic sound from occurring.

Extending from the bolt 14 in extension of the foot pedal 12 is an extension piece 16, which is connected to a lever configuration 17. The lever configuration 17 comprises a first lever 18, which is connected to the joined-on handle 5 of the cabasa, and which is connected at its other end via a pivot bearing 19 to a second lever 20, which, in turn, is connected via a pivot bearing 21 to the extension piece 16 of the foot pedal 12.

Between the second lever 20 and the joined-on handle 5 of the cabasa 2, a lockable free-wheel mechanism 22 is provided, which transfers the pivot movements of the first lever 18 to the joined-on handle 5, either in both directions or, optionally, only in one direction.

Figure 2:
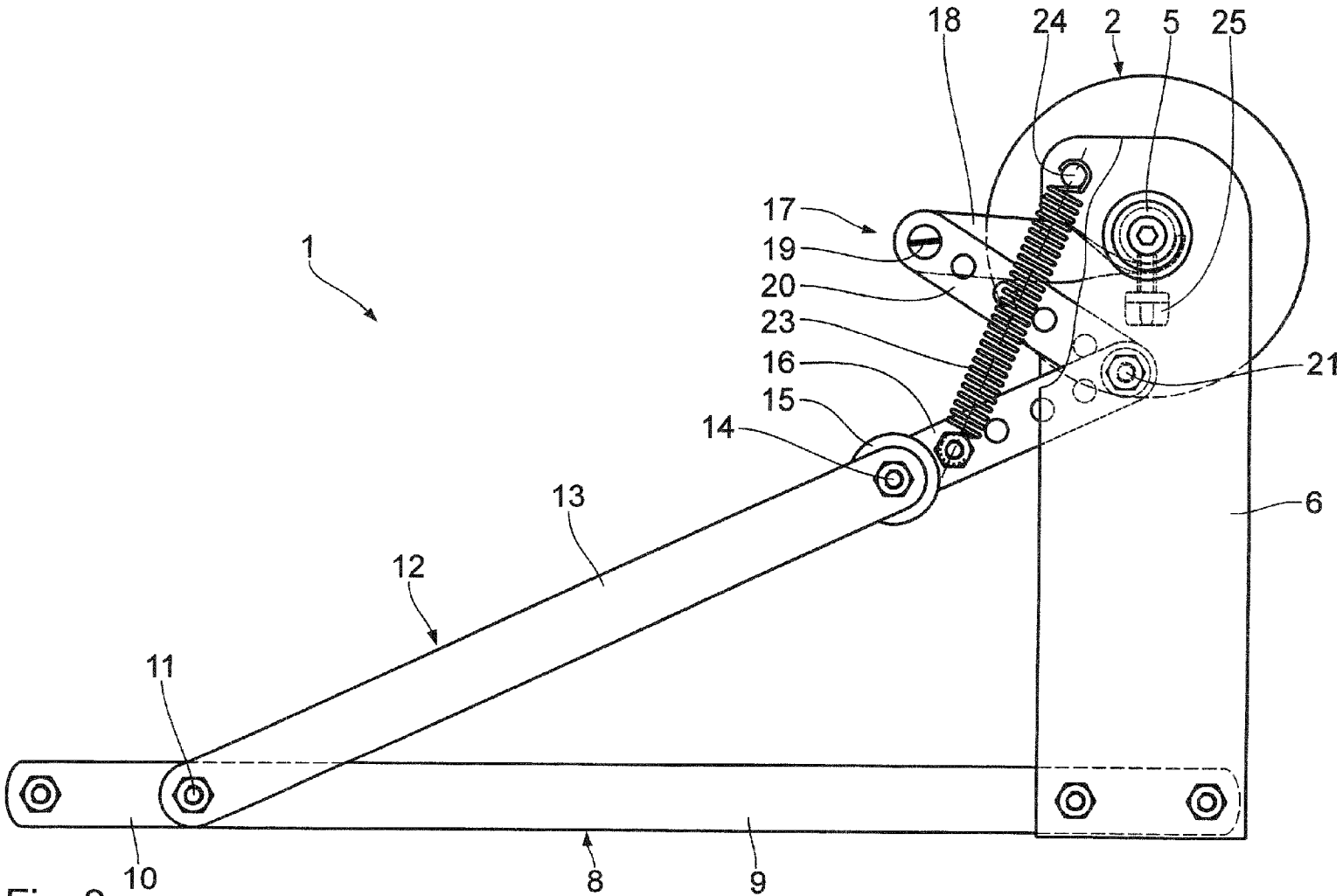
FIG. 2 shows a side view of the inventive musical instrument, with the foot pedal located in the normal position.
Figure 3:
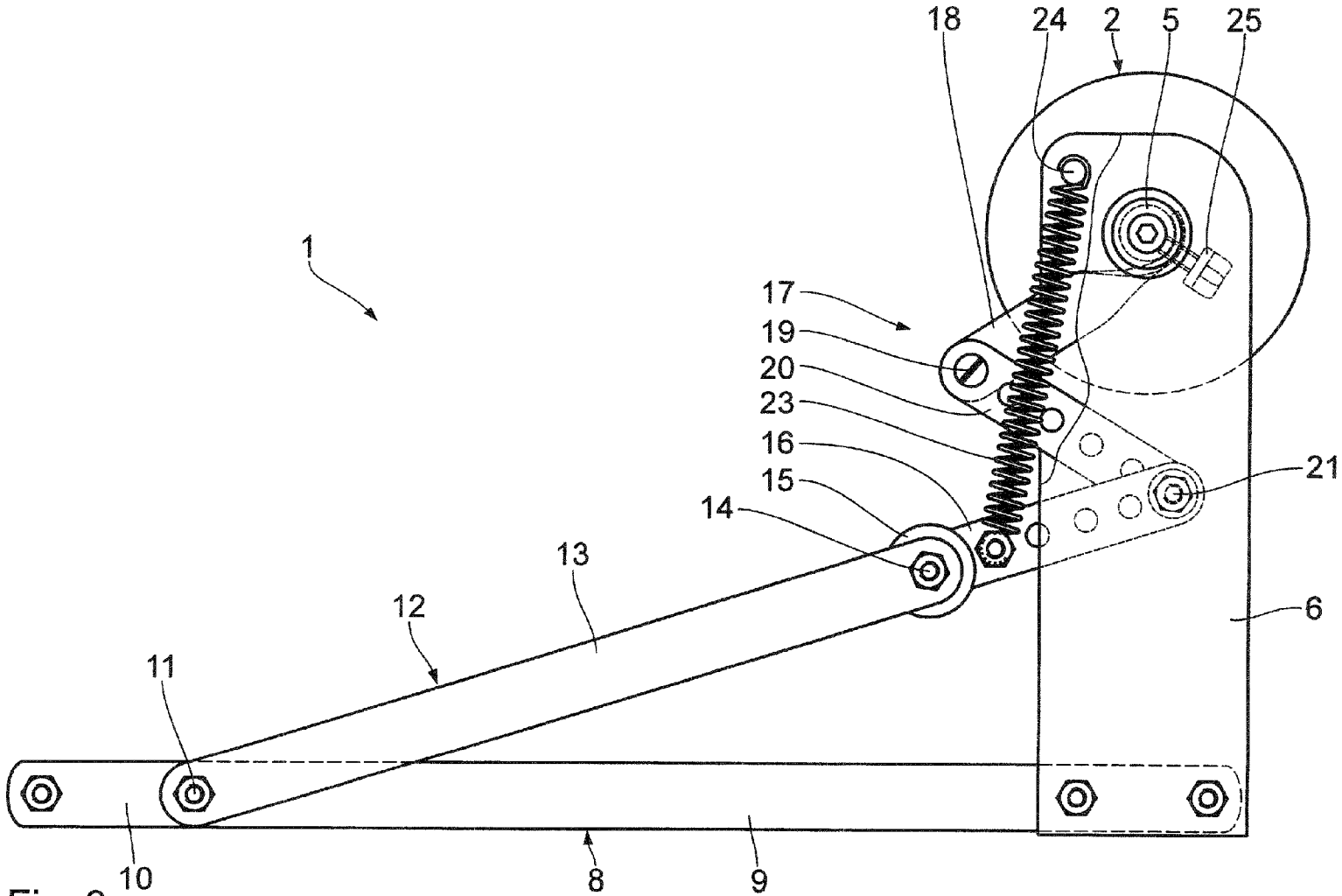
FIG. 3 shows a view corresponding to FIG. 2, with a partially downwardly depressed foot pedal.
Figure 4:
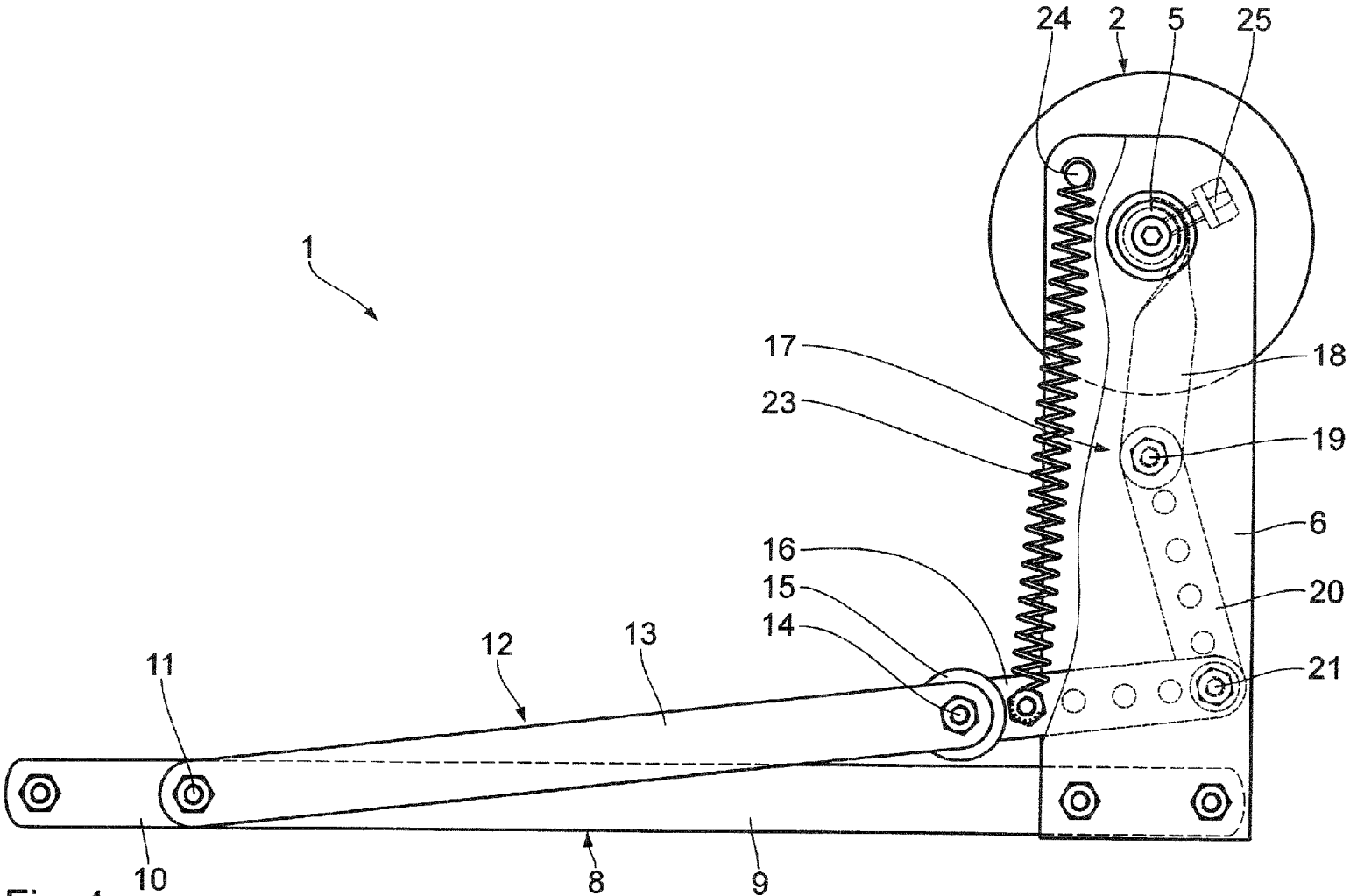
FIG. 4 shows a view corresponding to FIGS. 2 and 3 at a fully downwardly depressed foot pedal.

For resetting the foot pedal 12 into the normal position, a helical spring 23 is provided, which is affixed, at 24, to the upper end of a support 6 at one end and to the inner bottom end of the extension piece 16 of the foot pedal 12 at the other end, and which correspondingly pulls the foot pedal 12 into the normal position depicted in FIG. 2

For connecting the projecting handle 5 to the transmission linkage, a locking screw 25 is provided.

What is claimed is:

1. A musical instrument (1), comprising a so-called cabasa (2) with a cylindrical main body (3), about the periphery of which beaded sounding bodies (4) extend that interact with the surface of the main body (3) to produce a tone when a shaking movement is performed, and a joined-on handle (5) that extends away from the main body (3), wherein the joined-on handle (5) is mounted in a manner so as to be able to pivot, that a foot pedal (12) is provided, and that a pivot movement of the foot pedal (12) is converted by means of a transmission device, into a pivot movement of the joined-on handle (5).

2. A musical instrument (1) according to claim 1, wherein a base plate (8) is provided for mounting the cabasa (2), with supports (6) extending in an upwardly direction from one end of the base plate (8), wherein pivot bearings (7) for the joined-on handle (5) of the cabasa (2) are disposed in the region of the upper ends of the supports (6), and wherein a pivot bearing (11) for the foot pedal (12) is disposed in the region of the end of the base plate (8) opposite the supports (6).

3. A musical instrument (1) according to claim 1, wherein on the joined-on handle (5) of the cabasa (2), a first lever arm (18) is provided, which is connected via a pivot joint (19) to a second lever arm (20), wherein both lever arms (18, 20) together enclose an acute angle, and wherein the end of the second lever arm (20) opposite the pivot joint (19) is connected via an additional pivot joint (21) to the foot pedal (12) or to an extension (16) of the foot pedal (12).

4. A musical instrument (1) according to claim 1, wherein a reset spring (23) is provided, which pulls or pushes the foot pedal (12) back into its normal position at an incline relative to the base plate (8) after a downward deflection.

5. A musical instrument (1) according to claim 1 wherein the reset spring (23) is implemented in the form of a helical spring (23), which is affixed at one end to the top surface of the supports (6) and at the other end to the foot pedal (12).

6. A musical instrument (1) according to claim 1, wherein between the joined-on handle (5) of the cabasa (2) and the first lever arm (18), a lockable free-wheel mechanism (22) is disposed, which effects that, in dependence upon whether it is locked or not, both the upward and downward movement of the foot pedal (12) are converted into a pivot movement of the cabasa (2), or only one of these movements.

7. A musical instrument (1) according to claim 1, wherein the pedal mechanism is designed to be removable.

8. A musical instrument (1) according to claim 1, wherein the transmission device comprises a transmission linkage or toothed belt.

* * * * *

UNITED STATES PATENT AND TRADEMARK OFFICE

CERTIFICATE OF CORRECTION

PATENT NO. : 7,579,538 B2
APPLICATION NO. : 12/026177
DATED : August 25, 2009
INVENTOR(S) : Torsten Franz It is certified that error appears in the above-identified patent and that said Letters Patent is hereby corrected as shown below:

Title Page, Section (73) Assignee, "Roland Meinl Musik-lnstrumente GmbH & Co. KG" should be changed to --Roland Meinl Musikinstrumente GmbH & Co. KG--.

Signed and Sealed this

Third Day of November, 2009

David J. Kappos

David J. Kappos
*Director of the United States Patent and Trademark Office*